United States Patent [19]

Hedqvist et al.

[11] 4,002,489

[45] Jan. 11, 1977

[54] METHOD OF PICKLING METALLIC MATERIAL

[75] Inventors: Tore Hedqvist; Einar Gunnarsson; Benny Flodin, all of Torshalla, Sweden

[73] Assignee: Nyby Bruk AB, Sweden

[22] Filed: June 25, 1974

[21] Appl. No.: 482,999

[52] U.S. Cl. ..... 134/28; 134/3; 134/15; 134/41; 148/37; 156/651; 156/664

[51] Int. Cl.[2] ..... C23G 1/02; C23G 1/08

[58] Field of Search ..... 134/2, 3, 15, 28, 41; 156/18, 20; 252/142; 29/81 R; 148/37

[56] References Cited

UNITED STATES PATENTS

| | | | |
|---|---|---|---|
| 2,408,424 | 10/1946 | Healy | 134/41 |
| 2,796,334 | 6/1957 | Robinson | 252/142 |
| 2,942,954 | 6/1960 | Thomas | 134/41 |
| 3,057,764 | 10/1962 | Boda et al. | 156/20 |
| 3,072,516 | 1/1963 | Bellinger et al. | 156/20 |
| 3,161,598 | 12/1964 | Geld | 252/142 |
| 3,419,440 | 12/1968 | Rinaldo et al. | 134/3 |
| 3,433,670 | 3/1969 | Hill | 134/41 |
| 3,448,055 | 6/1969 | Mickelson et al. | 134/3 |
| 3,494,795 | 2/1970 | Chang | 134/3 |
| 3,562,013 | 2/1971 | Mickelson et al. | 156/20 |
| 3,598,741 | 8/1971 | Kanno | 134/3 |
| 3,632,447 | 1/1972 | Albrecht et al. | 134/28 |
| 3,666,580 | 5/1972 | Kreml et al. | 156/20 |

OTHER PUBLICATIONS

Lyman, Taylor; Metals Handbook, vol. 2, 8th ed. American Society for Metals, 1964, pp. 349–352.

*Primary Examiner*—Norman Yudkoff
*Assistant Examiner*—Dale Lovercheck
*Attorney, Agent, or Firm*—Craig & Antonelli

[57] ABSTRACT

A method of pickling metallic material particularly for the continuous treatment of material in strip or wire form and especially such material consisting of stainless steel, wherein the material after annealing is subjected in a first step to the chemical attack of a first aqueous solution which is heated to a temperature above room temperature, preferably to between 55° – 60° C, and which contains HF in contents of from 7 to 25%, or which contains HF in the contents mentioned above and $H_2SO_4$ over 2%, or which contains HF in the contents mentioned above the NaCl up to 10%, but especially from 0.5 to 2.5%; or which contains HF in the contents mentioned above and $H_2SO_4$ in the contents mentioned above and NaCl in the contents mentioned above, and in a second step the material is subjected to the chemical attack of a second aqueous solution heated to a temperature above room temperature, preferably to between 55° – 60° C, and containing HF and $HNO_3$.

20 Claims, No Drawings

METHOD OF PICKLING METALLIC MATERIAL

The present invention relates to a method of pickling metallic material particularly for the continuous treatment of material in strip or wire form and especially such material consisting of stainless steel.

In a known method according to Swedish Pat. specification No. 358,670 for pickling in particular stainless materials the pickling process is divided into two separate steps, whereby the first step comprises the use of an aqueous solution containing HF (hydrofluoric acid) and a mineral acid, particularly a strong one such as hydrochloric acid and thereafter an aqueous solution containing HF and a metal salt such as nitrate and particularly iron-3-nitrate ($Fe(NO_3)_3$).

When using the method described above on a production scale it has been found that the effect of the mineral acid, particularly $H_2SO_4$, in a first step was unsatisfactory due to the fact that the surface of the treated material showed a "strip pattern" particularly in austenitic material with ferrite in desired contents or with ferrite as undesired structural component. When HCl was used instead of $H_2SO_4$, acceptable results were obtained but the formation of Cl-vapour, which was troublesome both from a corrosion and health-endangering point of view, made its continuous use in the production impossible.

The second step too caused troublesome circumstances, particularly due to the formation of an adhering slimy brown film or skin on the surface of the material which could not be satisfactorily removed by existing washing and brushing equipment. Even the smallest residue led to corrosion, e.g. when storing the material.

It is an object of the present invention to eliminate the above-mentioned draw-backs of the method according to said Swedish patent.

The method according to the invention comprises pickling in at least two steps; in the first step the oxidized metal surface is subjected to the chemical attack of an aqueous solution which is heated to a temperature above room temperature, particularly above 30° C, but preferably between about 55° – 60° C and which substantially contains only HF in contents of from about 7 to 25 %, but particularly from about 15 to 20 %, or which contains HF in the contents mentioned above and an additional $H_2SO_4$ especially over 2 %, preferably between about 2 to 15 %, in particular about 5 to 12 %, or which contains HF in the contents mentioned above the NaCl up to about 10 % but especially from about 0.5 to 2.5 %, or which contains HF in the contents mentioned above and $H_2SO_4$ in the contents mentioned above and NaCl in the contents mentioned above; in the second step the material is subjected to the chemical attack of a second aqueous solution heated to a temperature above room or ambient temperature, particularly above 30° C but preferably to between about 55° – 60° C, which solution contains HF + $HNO_3$. The alternatives of the first pickling step according to this invention are distinguished in their results especially by an insensitiveness to over-pickling or over-etching, the best results being obtained using the last two alternatives.

With regard to the second pickling step it is to be mentioned that the addition of the hydrofluoric acid (HF) is a necessity in order to accomplish an etching of the basic material or metal for removing the dechromed layer resulting from the oxidization process; this etching is not employed in the first method step regardless of the alternative which is chosen.

The method according to the present invention, on a production scale, gives optimum and reproducible pickling processes and results.

The term optimum results as mentioned above means all the advantageous results which can be obtained with the present invention and not with the prior art, namely as regards environmental protection, reduced sensitiveness to over-etching at simultaneous high pickling rates, no adhering reaction products, no influence of the structure of the metal on the pickling process and considerably raised economy due to increased life of the pickling bath.

A number of representative examples are included to illustrate the invention. Although these examples describe in detail some of the more particular aspects of the invention, the examples are intended primarily for purposes of illustrating the invention and not to limit its scope.

EXAMPLE I

Step 1 15 – 20 % HF (55° – 60° C)
Step 2 15 – 20 % $HNO_3$ + 3 – 4 % HF (55° – 60° C)

EXAMPLE II

Step 1 15 – 20 % HF + 8 – 12 % $H_2SO_4$ (55° – 60° C)
Step 2 15 – 20 % $HNO_3$ + 3 – 4 % HF (55° – 60° C)

The pickling processes according to examples I and II in the first step do not eliminate the so-called "wood fiber pattern" (ferrite stripes) which is the result of certain production processes of the steel alloy.

EXAMPLE III

Step 1 15 – 20 % HF + 0.5 – 1.5 % NaCl (55° – 60° C)
Step 2 15 – 20 % $HNO_3$ + 3 – 4 % HF (55° – 60° C)

EXAMPLE IV

Step 1 15 – 20 % HF + 5 – 10 % $H_2SO_4$ + 0.5 – 1.5 % NaCl (55° – 60°)
Step 2 15 – 20 % $HNO_3$ + 3 – 4 % HF (55° – 60° C)

With these alternatives of the first step the "wood fiber pattern" was also eliminated.

All the method steps described above according to the examples permit considerably shorter treatment times, depending on the operation results from 30 to 50 %, especially when pickling Mo-alloyed strips, than conventional one-step pickling in only $HNO_3$ + HF. Moreover, the pickling surface is considerably more uniform, i.e. shows no over-etching effect which gives better finish than a conventionally pickled surface.

It should be mentioned that the addition of $H_2SO_4$ according to the invention can be replaced by the addition of another mineral acid which gives the same effect.

What we claim is:

1. A method of pickling metallic material consisting of stainless steel by the continuous treatment of said material in strip and wire forms wherein said material is subjected to a two-step pickling treatment which comprises a first step of subjecting the material to chemical attack of a first aqueous solution heated to a temperature above room temperature and containing HF in an amount of about 7 to 25% and a second step of subjecting said material to chemical attack of a second aqueous solution containing an acid different from the first aqueous solution, said second aqueous solution being heated to a temperature above room temperature and containing HF in an amount between about 1 and 7 % and $HNO_3$ in an amount between about 10 and 25%.

2. A method according to claim 1, wherein the HF content of the first aqueous solution is between about 15 and 20% and is at a temperature above 30° C.

3. A method according to claim 1, wherein the second solution has a HF content between about 3 and 4% and an $HNO_3$ content between about 15 and 20% and is at a temperature above 30° C.

4. A method according to claim 1, wherein the first aqueous solution contains NaCl in an amount of about 0.5 to about 10%.

5. A method according to claim 1, wherein the first aqueous solution contains $H_2SO_4$ in an amount above 2%.

6. A method according to claim 1, wherein the first aqueous solution contains mineral acids, other than $H_2SO_4$ which cause the same pickling effect in an amount above 2%.

7. A method according to claim 1, wherein the temperature of the first aqueous solution is above 30° C.

8. A method according to claim 7, wherein the temperature of the first aqueous solution is between about 55° and 60° C.

9. A method according to claim 1, wherein the temperature of the second aqueous solution is above 30° C.

10. A method according to claim 9, wherein the temperature of the second aqueous solution is between about 55° and 60° C.

11. A method according to claim 1, wherein the first aqueous solution contains $H_2SO_4$ in an amount of about 2 to 15%.

12. A method according to claim 11, wherein the first aqueous solution contains $H_2SO_4$ in an amount of about 5 to 12%.

13. A method according to claim 1, wherein the first solution contains, in addition to the HF and water, a pickling additive consisting essentially of $H_2SO_4$, NaCl, or $H_2SO_4$ and NaCl, and the second aqueous solution consisting essentially of water, HF and $HNO_3$.

14. The method according to claim 13, wherein the first aqueous solution contains from about 2 to 15% $H_2SO_4$, up to about 10% NaCl or 2 to 15% $H_2SO_4$ and up to 10% NaCl.

15. A method of pickling metallic material consisting of stainless steel by the continuous treatment of said material in strip and wire forms wherein said material is subjected to a two-step pickling treatment which comprises a first step of subjecting the material to chemical attack of a first aqueous solution which is heated to a temperature above room temperature and which contains acid consisting essentially of HF in an amount of about 15 to 25% and a second step of subjecting the material to chemical attack of a second aqueous solution which is heated to a temperature above room temperature and which contains acid consisting essentially of HF in an amount between about 1 and 7% and $HNO_3$ in an amount between about 10 and 25%.

16. A method of pickling metallic material consisting of stainless steel by the continuous treatment of said material in strip and wire forms wherein said material is subjected to a two-step pickling treatment which comprises a first step of subjecting the material to chemical attack of a first aqueous solution which is heated to a temperature above room temperature and which contains acid consisting essentially of HF in an amount of about 7 to 25% and a second step of subjecting said material to chemical attack of a second aqueous solution which is heated to a temperature above room temperature and which contains acid consisting essentially of HF in an amount between about 3 and 4% and $HNO_3$ in an amount between about 15 and 20%.

17. A method of pickling metallic material consisting of stainless steel by the continuous treatment of said material in strip and wire form, wherein said material is subjected to a two-step treatment, which comprises in the first step subjecting the material to the chemical attack of a first aqueous solution which is heated to a temperature above room temperature and which consists essentially of water, HF in an amount of about 15 to 25% and another mineral acid other than $HNO_3$ in an amount above 2%, and in the second step subjecting said material to the chemical attack of a second aqueous solution which is heated to a temperature above room temperature and which consists essentially of water, HF in an amount between about 1 and 7% and $HNO_3$ in an amount between about 10 and 25%.

18. A method of pickling metallic material consisting of stainless steel by the continuous treatment of said material in strip and wire form, wherein said material is subjected to a two-step treatment which comprises in the first step subjecting the material to the chemical attack of a first aqueous solution which is heated to a temperature above room temperature and which consists essentially of water, HF in an amount of about 15 to 25% and $H_2SO_4$ in an amount above 2%, and in the second step subjecting said material to the chemical attack of a second aqueous solution which is heated to a temperature above room temperature and which consists essentially of water, HF in an amount between about 1 and 7% and $HNO_3$ in an amount between about 10 and 25%.

19. A method of pickling metallic material consisting of stainless steel by the continuous treatment of said material in strip and wire form, wherein said material is subjected to a two-step treatment which comprises, in the first step subjecting the material to the chemical attack of a first aqueous solution which is heated to a temperature above room temperature and which consists essentially of water, HF in an amount of about 15 to 25% and $H_2SO_4$ in an amount of about 2 to 15%, and in the second step subjecting said material to the chemical attack of a second aqueous solution which is heated to a temperature above room temperature and which consists essentially of water, HF in an amount between about 1 and 7% and $HNO_3$ in an amount between about 10 and 25%.

20. A method of pickling metallic material consisting of stainless steel by the continuous treatment of said material in strip and wire form, wherein said material is subjected to a two-step treatment, which comprises in the first step subjecting the material to the chemical attack of a first aqueous solution which is heated to a temperature above room temperature and which consists essentially of water, HF in an amount of about 15 to 25% and $H_2SO_4$ in an amount of about 5 to 12%, and in the second step subjecting said material to the chemical attack of a second aqueous solution which is heated to a temperature above room temperature and which consists essentially of water, HF in an amount between about 1 and 7%, and $HNO_3$ in an amount between about 10 and 25%.

* * * * *